US009240645B1

(12) United States Patent
Ma

(10) Patent No.: US 9,240,645 B1
(45) Date of Patent: Jan. 19, 2016

(54) ELECTRICAL CONTACT

(71) Applicant: FOXCONN INTERCONNECT TECHNOLOGY LIMITED, Grand Cayman (KY)

(72) Inventor: Hao-Yun Ma, San Jose, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/492,099

(22) Filed: Sep. 22, 2014

(51) Int. Cl.
*H01R 13/24* (2006.01)

(52) U.S. Cl.
CPC ..... *H01R 13/2492* (2013.01)

(58) Field of Classification Search
CPC ..... H01R 13/24; H01R 13/2435; H01R 13/2457; H01R 13/2492
USPC ..... 439/66
See application file for complete search history.

(56) References Cited

U.S. PATENT DOCUMENTS 3,474,380 A * 10/1969 Miller ..... H01R 12/721 439/520
4,511,196 A * 4/1985 Schuler ..... H01R 23/6873 29/842
4,789,764 A * 12/1988 Doros ..... H01H 13/12 200/241
5,092,783 A * 3/1992 Suarez ..... H01R 4/48 439/66
5,857,857 A * 1/1999 Fukuda ..... H01R 31/08 439/188
6,149,443 A * 11/2000 Moran ..... H01R 13/2435 439/66
6,227,870 B1 * 5/2001 Tanaka ..... H01R 13/2435 361/749
6,359,215 B1 * 3/2002 Horng ..... H05K 9/0016 174/367
6,398,559 B2 * 6/2002 Tanaka ..... H01R 13/2435 439/66
6,423,915 B1 * 7/2002 Winter ..... H01Q 1/243 200/292
6,493,241 B1 * 12/2002 Horng ..... H05K 9/0064 206/719
6,627,813 B2 * 9/2003 Chen ..... H01L 23/552 174/390
6,676,456 B1 * 1/2004 Horng ..... H01R 13/2435 439/862
6,898,087 B1 * 5/2005 Chen ..... H01R 13/2435 174/138 G
7,131,875 B2 * 11/2006 Kodaira ..... H01R 13/2442 439/862
7,170,006 B1 * 1/2007 Burrell ..... H01M 2/1066 174/94 R
7,220,152 B2 * 5/2007 Jeong ..... H01R 13/2492 439/862
7,263,770 B2 * 9/2007 Mendenhall ..... H01R 13/2435 29/832
7,578,712 B2 * 8/2009 Chang ..... H01H 13/78 200/292
7,625,216 B2 * 12/2009 Mendenhall ..... H01R 13/2435 439/66
7,651,381 B2 * 1/2010 Chuang ..... H01R 12/57 439/66
7,803,011 B1 * 9/2010 Mai ..... H01R 13/2428 439/500
7,806,739 B2 * 10/2010 Hu ..... H01R 13/2442 439/862
7,938,647 B2 * 5/2011 Zheng ..... H01R 12/714 439/66
7,989,045 B2 * 8/2011 Chang ..... H01R 12/57 174/366
8,052,428 B2 * 11/2011 Tsao ..... H01R 4/4809 439/66
8,162,673 B2 * 4/2012 Chen ..... H05K 9/0064 439/66
8,202,603 B2 * 6/2012 Chang ..... H01R 12/57 174/366
8,206,188 B1 * 6/2012 Zhang ..... H01R 12/57 439/862
8,282,430 B2 * 10/2012 He ..... H01B 5/00 439/862
8,298,021 B2 * 10/2012 Huang ..... H01R 13/2442 439/500

(Continued)

*Primary Examiner* — Ross Gushi
(74) *Attorney, Agent, or Firm* — Wei Te Chung; Ming Chieh Chang

(57) ABSTRACT

An electrical contact (1) includes a base portion (10) for connecting with a first device (2), a first spring arm (12) extends from the base portion (10) and includes a first contact tip (121) at the end thereof for connecting with the first device (2) and a second contact tip (122) near the base portion (10) for connecting with a second device (3), at a first stage, the base portion (10) is higher than the second contact tip (122) and the second contact tip (122) is higher than the first contact tip (121), at another stage, the base portion (10) and the first contact tip (121) are in a same height to contact the first device (2) and the second contact tip (122) is lower than the first contact tip (121) to contact the second device (3).

20 Claims, 5 Drawing Sheets

(56) References Cited

U.S. PATENT DOCUMENTS 8,482,468 B2 * 7/2013 Park ..... H01Q 1/12 343/702
8,517,777 B2 * 8/2013 Haans ..... H01R 12/57 439/819
8,517,779 B2 * 8/2013 Zhang ..... H01R 4/64 439/862
8,569,626 B2 * 10/2013 Kurita ..... H01R 12/57 174/94 R
8,926,338 B2 * 1/2015 Kiryu ..... H01R 13/2442 439/66
8,974,257 B1 * 3/2015 Xie ..... H01R 12/57 439/862
2006/0276085 A1 * 12/2006 Ma ..... H01R 13/2464 439/862
2007/0059976 A1 * 3/2007 Yeh ..... H01M 2/20 439/500
2009/0170378 A1 7/2009 Harada
2015/0062847 A1 * 3/2015 Park ..... H05K 1/11 361/760

* cited by examiner

ELECTRICAL CONTACT

BACKGROUND OF THE INVENTION

1. Field of the Invention

The present invention relates to electrical contact, and more particularly to electrical contact having multiple contact tips.

2. Description of Related Art

An conventional electrical contact locates between two members for electrically connecting with the two members. US publication number 2009170378 issued to Harada on Dec. 21, 2011 disclosed such conventional contact. The electrical contact includes a flat base, a tail and a spring arm extending from the flat base. The end of the spring arm defines a contact tip for electrically connecting with a first device. The tail is used for electrically connecting with a second device. Thus, a robust electrical connection is established between the first device and the second device.

When the spring arm is pressed, it will be deformed to provide a elasticity force ensure the contact top touch with the first device. But, the spring arm will have a bad elasticity due to long times use. Thus, the electrical connection between the contact tip and the first device can not be ensuring.

Hence, it is desirable to provide an improved electrical contact to overcome the aforementioned disadvantages.

SUMMARY OF THE INVENTION

Accordingly, an object of the present invention is to provide an electrical contact having multiple contact tips.

According to one aspect of the present invention, an electrical contact includes a base portion for connecting with a first device, a first spring arm extends from the base portion and includes a first contact tip at the end thereof for connecting with the first device and a second contact tip near the base portion for connecting with a second device, at a first stage, the base portion is higher than the second contact tip and the second contact tip is higher than the first contact tip, at another stage, the base portion and the first contact tip are in a same height to contact the first device and the second contact tip is lower than the first contact tip to contact the second device.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
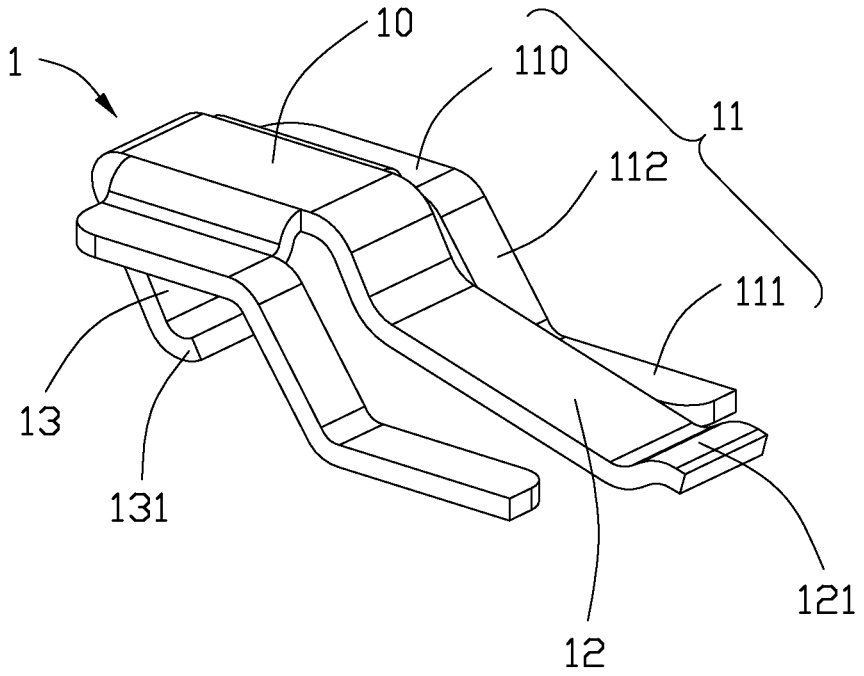
FIG. 1 is an isometric view of an electrical contact according to the present invention.
Figure 2:
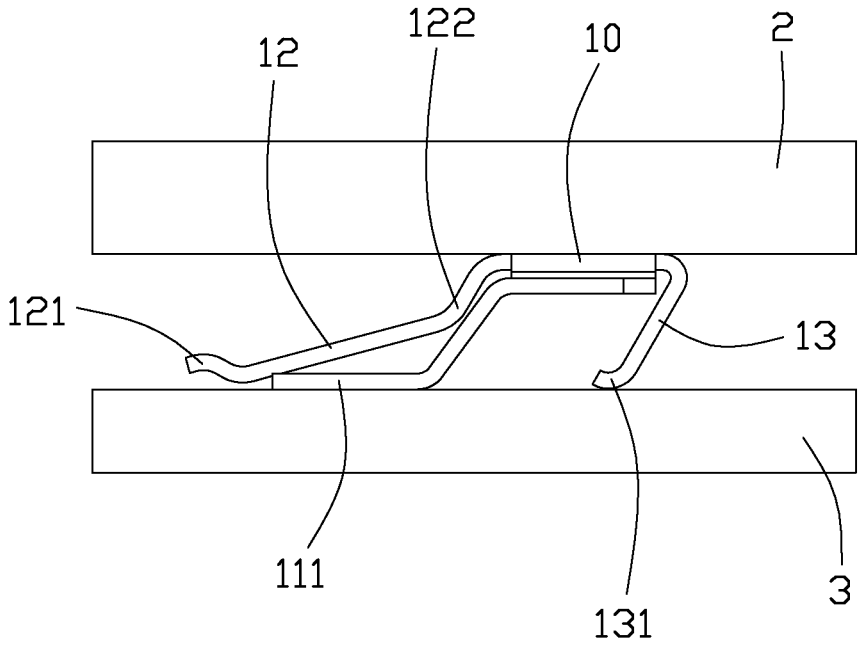
FIG. 2 is a side view of the electrical contact as shown in FIG. 1, wherein the electrical contact connects with a first device and a second device.

FIGS. 1-2 illustrate an electrical contact 1 in accordance to a preferred embodiment of the present invention. The electrical contact 1 is used to connecting a first device 2 with a second device 3. The electrical contact 1 includes a flat base portion 10 for connecting with the first device 2, a pair of legs

11 extending from two opposite ends of the base portion 10, a first spring arm 12 and a second spring arm 13 extending from the other opposite ends of the base portion 10. The pair of legs 11, the first spring arm 12 and the second spring arm 13 all extend toward a same direction and the first spring arm 12 locates between the pair of legs 11.

Each of the pair of legs 11 includes an connecting portion 110 extending from the base portion 10, an extending portion 112 extending from the connecting portion 110 and an supporting portion 111 extending from the extending portion 112. The base portion 10, the connecting portion 110 and the supporting portion 111 are paralleled with each other. The supporting portion 111 supports on the second device 3 to connect with the second device 3.

The first spring arm 12 includes a first contact tip 121 at the end thereof and a second contact tip 122 near the base portion 10. Before the electrical contact 1 is pressed, the base portion 10 is higher than the second contact tip 122 and the second contact tip 122 is higher than the first contact tip 121. The second spring arm 13 includes a contact portion 131 at the end thereof.

Referring to FIG. 2, when the electrical contact 1 is assembled between the first device 2 and the second device 3 in a first stage, the supporting portions 111 of the pair of legs 11 and the contact portion 131 of the second spring arm 13 connecting with the second device 3, the base portion 10 connecting with the first device 2, the first contact tip 121 and the second contact tip 122 disconnected with the first device 2 and the second device 3.

Figure 3:
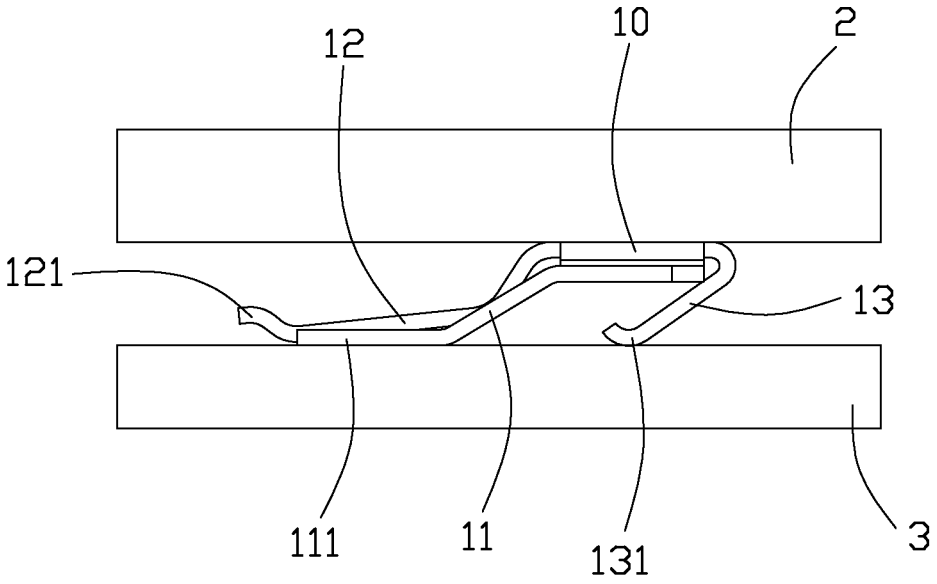
FIG. 3 is similar to FIG. 2, wherein the electrical contact is pressed by the first device to a first stage.
Figure 4:
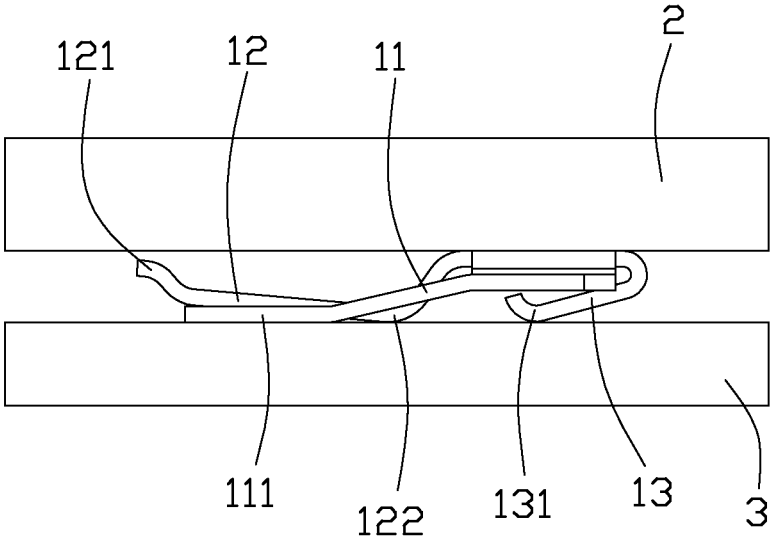
FIG. 4 is similar to FIG. 3, wherein the electrical contact is further pressed by the first device to a second stage.

Referring to FIGS. 3-4, the first device 2 exert a downward force on the electrical contact 1 to make the first spring arm 12, the pair of legs 11 and the second spring arm 13 all deformed. During this process, the second contact tip 122 contact the second device 3 and the first contact tip 121 is lifted up to a position higher than the second contact tip 122.

Figure 5:
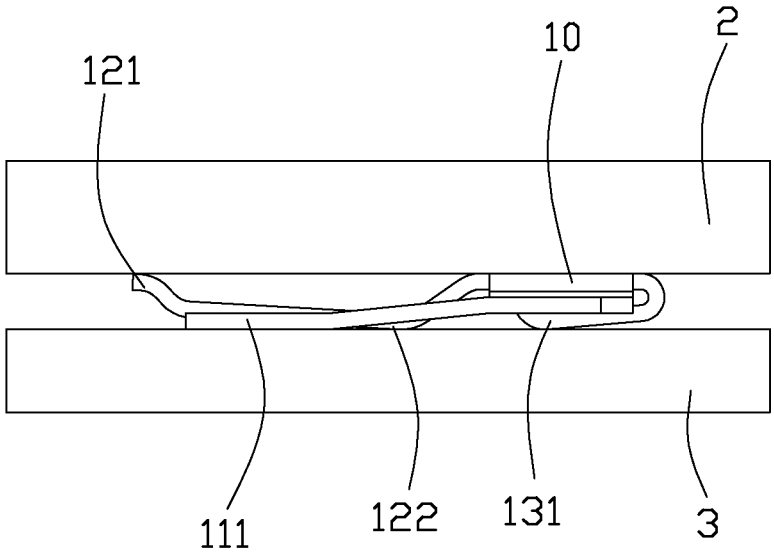
FIG. 5 is similar to FIG. 3, wherein the electrical contact is further pressed by the first device to a last stage.

Referring to FIG. 5, due to the further movement of the first device 2, the first contact tip 121 is lifted up to a same height with the base portion 10 to contact the first device 2. At this stage, the first contact tip 121 of the first spring arm 12, the base portion 10 contact the first device 2, the second contact tip 122 of the first spring arm 12, the contact portion 131 of the second spring arm 13, the supporting portions 111 of the legs 11 contact the second device 3, due to the multiple contact tips between the first device 2 and the second device 3, a robust electrical connection between the first device 2 and the second device 3 is established. At the same time, the legs 11, the first spring arm 12 and the second spring arm 13 all has elasticity to ensuring a good elasticity of the electrical contact 1.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical contact for contacting a first device and a second device, and comprising:

a base portion for connecting with the first device;

a first spring arm extending from the base portion and including a first contact tip at the end thereof for connecting with the first device and a second contact tip near the base portion for connecting with the second device; wherein at a first stage, the base portion is higher than the second contact tip and the second contact tip is higher than the first contact tip; wherein at another stage, the base portion and the first contact tip are in a same height to contact the first device and the second contact tip is lower than the first contact tip to contact the second device.

2. The electrical contact as claimed in claim 1, wherein further includes a second spring arm, the first spring arm and the second spring arm extend from two opposite ends of the base portion toward a same direction, the second spring arm includes a contact portion for connecting with the second device.

3. The electrical contact as claimed in claim 2, wherein further includes a pair of legs extends from the other opposite ends of the base portion, the pair of legs and the first spring arm extend toward a same direction and the first spring arm locates between the pair of legs.

4. The electrical contact as claimed in claim 3, wherein the leg includes an connecting portion extending from the base portion, an extending portion extending from the connecting portion and an supporting portion extending from the extending portion for connecting with the second device.

5. The electrical contact as claimed in claim 4, wherein the base portion, the connecting portion and the supporting portion are paralleled with each other.

6. An electrical contact for connecting with a first device and a second device, and comprising:

a base portion for connecting with the first device;

a first spring arm and a second spring arm extending from two opposite ends of the base portion, the first spring arm including a first contact tip at the end thereof and a second contact tip near the base portion, the second spring arm including a contact portion at the end thereof; wherein at a first stage, the base portion connects with the first device, the contact portion connects with the second device, the first contact tip and the second contact tip disconnects with the first device and the second device; wherein at another stage, the base portion and the first contact tip connect with the first device, the contact portion and the second contact tip connect with the second device.

7. The electrical contact as claimed in claim 6, wherein the first spring arm and the second spring arm extend toward a same direction.

8. The electrical contact as claimed in claim 6, wherein further includes a pair of legs extends from the other opposite ends of the base portion, the pair of legs and the first spring arm extend toward a same direction and the first spring arm locates between the pair of legs.

9. The electrical contact as claimed in claim 8, wherein the leg includes an connecting portion extending from the base portion, an extending portion extending from the connecting portion and an supporting portion extending from the extending portion for connecting with the second device.

10. The electrical contact as claimed in claim 9, wherein the base portion, the connecting portion and the supporting portion are paralleled with each other.

11. An electrical contact for use between opposite and parallel upper and lower pieces, comprising:

an upper horizontal section adapted to contact the upper piece;

a lower horizontal section adapted to contact the lower piece and essentially spaced from said upper horizontal section in a vertical direction and in a parallel relation;

a first oblique section having a first upper end linked to the upper horizontal section and a first lower end adapted to contact the lower piece;

a second oblique section spaced from the first oblique section in a parallel relation and having a second upper end linked to the upper horizontal section and a second low end linked to the lower horizontal section; and a third oblique section being oblique to all said upper horizontal section, said lower horizontal section, said first oblique section and said second oblique section, said third oblique section being less steep than the first oblique section and the second oblique section and having a third upper end linked to the upper horizontal section;

wherein said third oblique section defines a first contact point adapted to contact the lower piece when the upper piece and the lower piece are, during an operation, approaching each other in the vertical direction around an initial stage, and a second contact point spaced from the first contact point in a front-to-back direction perpendicular to said vertical direction, and adapted to contact the lower piece when the upper piece and the lower piece are around a final stage.

12. The electrical contact as claimed in claim 11, wherein the first oblique section and the second oblique section are deformed in a parallelogram pattern during said operation.

13. The electrical contact as claimed in claim 11, wherein the first contact point no longer contacts the lower piece at the final stage.

14. The electrical contact as claimed in claim 11, wherein said third oblique section extends longer than both said first oblique section and said second oblique section.

15. The electrical contact as claimed in claim 11, wherein the first oblique section and the third oblique section are aligned with each other in the front-to-back direction while the second oblique section is located beside both the first oblique section and the third oblique section in a transverse direction perpendicular to both said vertical direction and said front-to-back direction.

16. The electrical contact as claimed in claim 11, wherein the upper horizontal section essentially defines an offset arrangement thereof with an upper level portion and a lower level portion, and the first oblique section is linked to the upper level portion while the second oblique section is linked to the lower level portion.

17. The electrical contact as claimed in claim 11, wherein the third oblique section includes a third contact point which is located adjacent to the first contact point and adapted to contact the upper piece at the final stage.

18. The electrical contact as claimed in claim 11, wherein the first oblique section and the third oblique section are located at a centerline of the contact, and the second oblique section cooperate with another second oblique section to sandwich the third oblique section in a transverse direction perpendicular to both said vertical direction and said front-to-back direction.

19. The electrical contact as claimed in claim 11, wherein the first oblique section is linked to a front edge of the upper horizontal section while both said second oblique section and said third oblique section are linked to a rear edge of the upper horizontal section.

20. The electrical contact as claimed in claim 11, wherein a third upper end of the third oblique section is lower than the second upper end of the second oblique section which is lower than the first upper end of the first oblique section.

* * * * *